United States Patent [19]

Burandt

[11] Patent Number: 4,638,772

[45] Date of Patent: Jan. 27, 1987

[54] VALVE ACTUATING APPARATUS FOR MINIMIZING THE NEED FOR LASH ADJUSTMENT

[75] Inventor: Corliss O. Burandt, Plymouth, Minn.

[73] Assignee: Investment Rarites, Incorporated, Minneapolis, Minn.

[21] Appl. No.: 693,847

[22] Filed: Jan. 25, 1985

Related U.S. Application Data

[63] Continuation of Ser. No. 595,302, Mar. 30, 1984.

[51] Int. Cl.[4] ..... F01L 1/04

[52] U.S. Cl. ..... 123/90.6; 123/90.49; 123/90.50

[58] Field of Search ..... 123/90.6, 90.48, 90.49, 123/90.50

[56] References Cited

U.S. PATENT DOCUMENTS

| | | | |
|---|---|---|---|
| 3,303,833 | 2/1967 | Melling | 123/90.48 |
| 3,403,667 | 10/1968 | Santi | 123/90.6 |
| 3,675,631 | 7/1972 | Hixson | 123/90.52 |
| 4,409,935 | 10/1983 | Henn et al. | 123/90.6 |

FOREIGN PATENT DOCUMENTS

| | | | |
|---|---|---|---|
| 1900087 | 7/1969 | Fed. Rep. of Germany | 123/90.52 |
| 254213 | 7/1927 | Italy | 123/90.48 |
| 151105 | 11/1980 | Japan | 123/90.48 |
| 213789 | 3/1941 | Switzerland | 123/90.6 |

*Primary Examiner*—E. Rollins Cross

*Attorney, Agent, or Firm*—Peterson, Wicks, Nemer & Kamrath

[57] ABSTRACT

A cam unit and a follower at the upper end of the valve stem are configured so that the surfaces between which lash is measured are for all intents and purposes removed or segregated from the surfaces used for effecting valve movement. The modified interaction between the cam and the surface the cam bears against compensates for reduction in valve lash. The segregation is achieved by employing a button having a reduced area engaged by the ramp portions of the cam unit, the ramp portions having a width at least as great as that of the button. In one embodiment, the button is softer than the ramps. Provision is also made for dimensionally correlating the working surface of the cam and follower with the amount of load needed at any given moment to open or close the valve.

14 Claims, 13 Drawing Figures

VALVE ACTUATING APPARATUS FOR MINIMIZING THE NEED FOR LASH ADJUSTMENT

CROSS-REFERENCE TO RELATED APPLICATION

This is a continuation of application Ser. No. 595,302, filed Mar. 30, 1984 for APPARATUS UTILIZING A PLURAL-PROFILED CAM UNIT FOR ACTUATING THE VALVE OF AN INTERNAL COMBUSTION ENGINE contains subject matter generally related to this application in that my above-identified continuation application is concerned with reducing the amount of lash increase.

BACKGROUND OF THE INVENTION

This invention relates generally to apparatus for controlling the opening and closing of the valves of an internal combustion engine, and pertains more particularly to apparatus for virtually eliminating the need for any adjustment to reduce the amount of lash decrease during the entire life span of a typical automobile engine.

The problem of lash change with respect to the valves of an internal combustion engine has long been recognized. As a result, various efforts have been made for adjusting valve lash. For instance, hydraulic lash adjusters have been employed to provide automatic adjustment. Also, the use of shims has become widespread, especially on engines utilizing four valves per cylinder. Obviously, the use of hydraulic lash adjusters involves additional cost and results in increased friction. On the other hand, the substitution of one thickness of shim for another, while rather inexpensive as far as materials are concerned, can be quite costly as far as labor is concerned.

Changes in lash are attributable to a number of factors. In some instances, the lash will increase and in others the lash will decrease. An increase in the length of the valve stem will, for instance, decrease the lash. Likewise, erosion of the valve seat can contribute to a decrease in lash, as well as erosion of the valve head. Where steel inserts are employed, such inserts tend to retract into the head when the head is made of aluminum. Where lash increases, in contradistinction to decreasing, there is also a problem. However, if cam and follower wear can be minimized, then a predetermined small amount of lash can be selected at the factory and the likelihood of increase in such lash will be substantially reduced. However, where the engine design is such that a definite increase in lash is apt to occur, it is recommended that the invention disclosed in my said copending application, Ser. No. 595,302, be employed.

SUMMARY OF THE INVENTION

A general object of my invention is to preserve as closely as practical the original lash clearance. In this regard, an aim of the invention is to obtain the necessary cam and follower profiles with virtually no increase in manufacturing costs when compared with manually adjustable valves, and at a substantially less cost when compared with hydraulic lash adjusters.

A more specific object of my invention is to for all intents and purposes segregate the surfaces not used to initiate valve movement from those surfaces actually involved in the achieving of valve movement. In this regard, it is recognized that erosion occurs mainly on the surfaces used to move the valve during both the opening and closing thereof. Thus, the lobe of the cam, which forces the valve open and also permits the valve to close by spring action, causes the major amount of wear due to its repeated engagement with the follower or actuator, the wear being particularly pronounced on the surface areas used during the major portion of the valve opening. Consequently, an aim of my invention is to provide a cam profile, as well as a follower configuration, in which the lobe engages the follower over a relatively large surface, whereas the clearance ramps contact a relatively small surface area, an area physically isolated from the major area engaged by the lobe. In those instances where clearance ramps are not employed, the base circle would contact only a relatively small surface area.

More specifically, to provide the smaller area mentioned above, it is within the purview of the invention to utilize a relatively small contact area in the form of a button that is engaged by the clearance ramps so that the button, by virtue of its reduced area, will wear more rapidly than the general surface area engaged by the cam lobe should the lash become less than desired. In this way, there is an automatic compensation for any decrease in lash, for the concentrated area in the form of the button wears away if the lash decreases, to maintain, or at least substantially maintain, the original clearance or lash. With my invention, the original clearance or lash could at the outset be set virtually to zero, particularly for intake valves, as far as the engagement of the opening and closing ramps with the follower on the valve stem. In this way, if the lash increases, any such increase progresses from a virtually zero amount of clearance or lash to whatever the increase happens to be. This is a decided advantage over having to provide an appreciable amount of lash to begin with and then have the lash increase from that value so that the increased lash becomes objectionable. In other words, the present apparatus, while primarily intended to compensate for lash decrease also has the advantage of minimizing to some extent the effect of an increase in lash.

Another object is to provide a cam profile in which the lifting portion of the cam profile, that is, the lobe portion, can be made to vary from a maximum width at the moment that the valve opening is initiated down to a narrower width after the valve is fully open. In this way, a greater amount of contact surface between the cam and the follower or actuator is achieved when maximum valve opening occurs, decreasing at the point where the valve actuator has begun to return to its closed position.

Yet another object of the invention is to provide a cam profile that lends itself readily to being cast integrally with the camshaft itself. More specifically, by being able to utilize the casting process, which is normally used to make conventional camshafts, the benefits of my invention can be realized without any significant increase in manufacturing costs. In this regard, it is typical to use cam grinding techniques to manufacture conventional camshafts, and these techniques can be utilized without modification when practicing the teachings of my invention. However, the lateral dimensions of the cam profile can be achieved by modifying the casting process used to create the cam lobe, only a change in the pattern being necessary to accomplish this. Also, an aim of the invention is to enable a camshaft when using my invention to be made lighter in weight. In this regard, it is possible to use beveled or tapered surfaces which make each of the cams on the camshaft of less mass, thereby reducing the weight of the camshaft and the cams formed thereon.

Still further, an object of the present invention is to obviate the need for changing shims as done in the past because any change in valve lash is virtually eliminated. Also, it is within the scope of the present invention to avoid using hydraulic lash adjusters which in the past have not only been quite costly but which have developed an objectionable amount of friction during their operation.

Also, the invention has for an object the achieving of an enhanced lubrication. The maintenance of the proper amount of lash, quite obviously, enables a space or clearance to be maintained where a greater quantity of lubricating oil can flow to, so that when the cam lobe does engage the follower or valve actuator, which it does once during each revolution of the camshaft, there is always oil present which the cam lobe literally squeezes out. On the other hand, where wear in the past has decreased the lash to virtually zero, then there results a constant contact and rubbing of the cam throughout its entire profile with the follower or valve actuator, thereby preventing oil from entering the region between the base circle portion of the cam and the follower to provide the needed lubrication.

Briefly, my invention envisages a specially profiled cam unit, as well as a specially constructed cam follower or valve actuator. In one embodiment of the invention, the valve actuator includes a one-piece special shim having a button thereon formed by an annular groove. Circumferentially disposed with respect to the integral button is an annular surface area. The cam unit is configured so that the lobe portion thereof will span both the button and a sizable proportion of the annular working surface to either side of the button. In this way, the lobe portion engages a substantial working area but the leading and trailing ramp portions engage only the limited area provided by the button.

Specifically, the cam unit is designed so that it has a base circle rib that is decidedly narrower than the width of the cam lobe. Additionally, the cam unit includes ramp portions that have just been mentioned and which are of the same width as the base circle portion. The width of the ramp portions and the base circle portion is correlated with the width or diameter of the button so that the width of the button is no greater than the width of the ramp and base circle rib. In this way, when there is a decrease in lash, then the relatively narrow ramps will simply engage the button at a progressively greater rate and the button will wear away so as to compensate automatically for any decrease in lash. Because the decrease in lash is adequately compensated for, the original amount of clearance or lash that is selected can be substantially reduced, or possibly eliminated (that is, reduced to zero).

In a second embodiment of the invention, a shim provided with an insert having a button of relatively soft metal is utilized so that the ramp portions wear away the relatively soft button when there is a sufficient decrease in lash. Here again, the lash can be initially adjusted at the factory to a very small clearance. In either situation, should the lash increase, it will increase from a relatively small value to whatever amount of lash results. It is contemplated, though, that the lash for various reasons will decrease, and any such decrease is compensated for by the wearing away of the relatively soft button.

By tapering and diverging the cam lobe, the lifting portion of the cam profile, that is, the lobe portion of the cam unit, can be changed from a maximum width at the beginning of the valve movement (that is, the initiation of valve opening or lift) to a narrower width when the valve movement enters its closing mode. In this way, the contact area on the follower or valve actuator will be the greatest at the point of maximum stress during the opening of the valve but can be made to decrease to substantially less contact at the very location where the valve actuator stresses are lower during the closing of the valve, this being achieved by optimizing the reduced cam lobe width by using an appropriate tapered configuration. In other words, by imparting a degree of divergence or taper to the cam lobe, the contact area between the cam unit and the follower or valve actuator can be made to vary in a relationship such as to minimize the effects of friction.

DETAILED DESCRIPTION OF THE PREFERRED EMBODIMENTS

Figure 1:
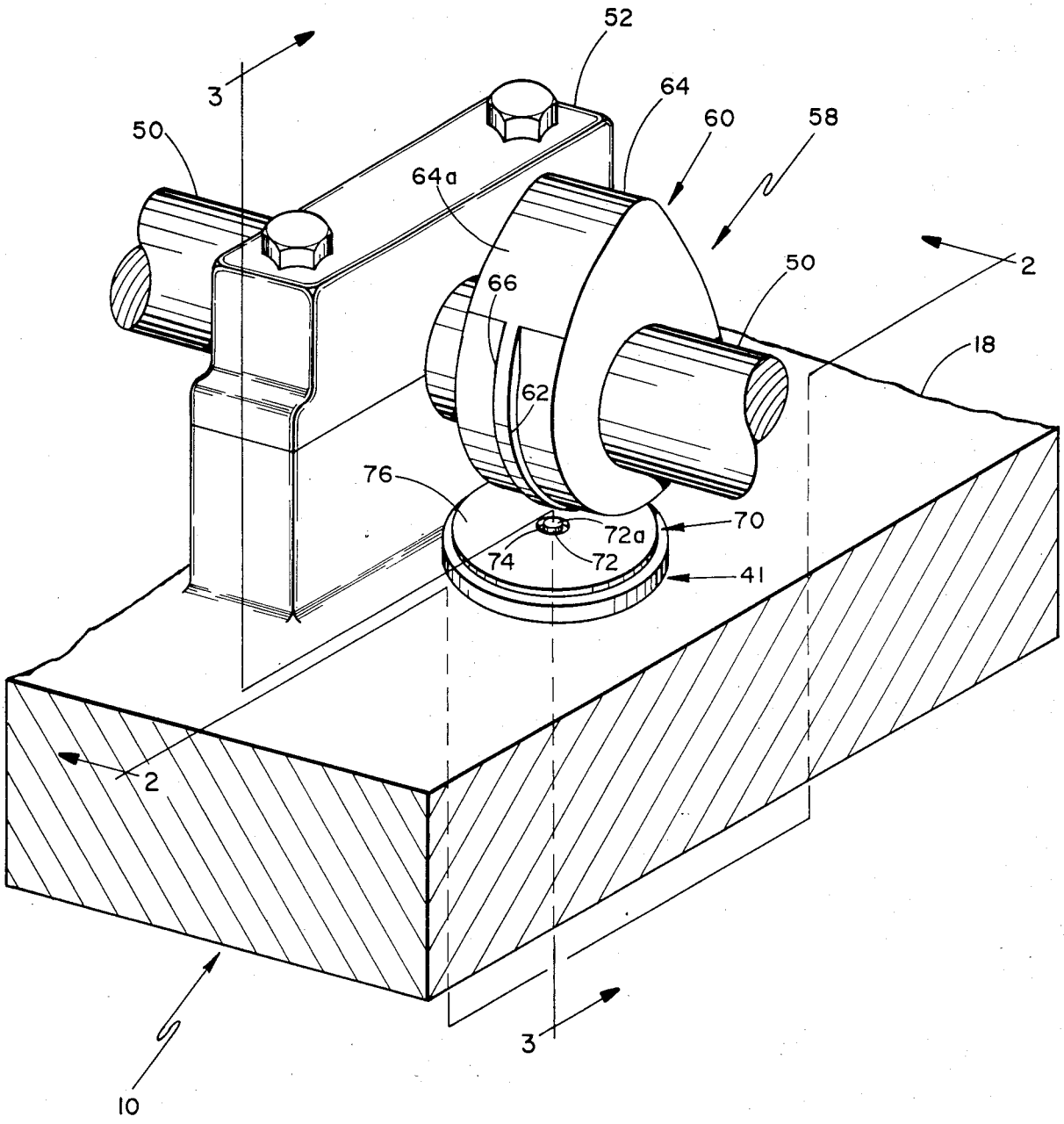
FIG. 1 is a perspective view of one form of my valve actuating apparatus, the apparatus being employed with a fragmentarily depicted cylinder block belonging to a conventional internal combustion engine.

Referring now to the drawings, a conventional internal combustion engine 10 has been only fragmentarily illustrated. The engine 10 includes an engine block 12 containing therein any number of combustion chambers or cylinders 14, only a portion of one of which chambers or cylinders 14 appears in FIGS. 3–9. These same figures show a portion of a piston 16 that reciprocates vertically within the chamber or cylinder 14. Being conventionally reciprocated, it is not believed necessary to show the piston rod and crankshaft. Overlying the cylinder block 12 and secured thereto is a cylinder head 18.

From FIGS. 3–9 it will be further noted that there is a valve port 20 formed in the lower side of the cylinder head 18 by virtue of a downwardly facing beveled seat 22. The valve port 20 provides an intake opening, there being a passage 24 that connects the port 20 to the intake manifold (not shown) of the engine 10.

Also typical of internal combustion engines, such as that labeled 10, is a reciprocating valve 26 having a valve head 28 at its lower end, the valve head 28 being beveled at 30 so as to seat against the beveled seat 22 when the valve is closed. Extending upwardly from the head 28 is a stem 32, the stem being guided for reciprocable movement by a sleeve bearing 34. Additionally, there is a coil spring 36 encircling the valve stem 32. The lower end of the spring 36 abuts against a portion of the cylinder head 28, whereas the upper end of the spring 36 abuts against the underside of a retaining ring 38, the retaining ring 38 being held in place by conventional semi-cylindrical keepers 40.

A cup-shaped cam follower or valve actuator 41 has a closed disk-like upper end 42 and an upstanding annular flange 44 extending circumferentially therearound. Extending downwardly from the disk-like upper end 42 is a cylindrical skirt 46 which moves vertically within a bore 48.

The underside of the disk-like end 42 acts against the upper end of the valve stem 32. Although it will become more obvious as the description progresses, it can be pointed out at this early stage that the valve 26, while referred to as opening and closing an inlet port 20, and thereby constituting an intake valve, could, as far as the instant invention is concerned, be an exhaust valve. In other words, my invention is suitable for use with both intake and exhaust valves.

Also forming part of the internal combustion engine 10 is a camshaft indicated generally by the reference numeral 50. The camshaft 50, it will be appreciated, has a length sufficient for whatever number of combustion chambers or cylinders 14 are employed in the engine 10. Since the length is determined by the number of combustion chambers 14, an appropriate number of bearings 52 would be used in actual practice, only one such bearing 52 appearing in the drawings. The bearings 52, quite obviously, cause the camshaft 50 to rotate about a longitudinal axis spaced a certain distance above the valve seat 22.

The foregoing description has dealt with the construction of a conventional internal combustion engine that has been denoted by the reference numeral 10. Even though conventional, the parts that have been referred to are important as far as understanding how my invention can be employed in conjunction therewith. Therefore, at this time, reference will be made to one form of my valve actuating apparatus, this apparatus being generally indicated by the reference numeral 58. Camshafts, such as the camshaft 50, are typically cast and when being cast, cam units, one for each combustion chamber or cylinder 14, are formed integrally thereon. This same procedure is utilized when practicing my invention, for a cam unit 60 is made integral with the camshaft 50, together with whatever additional cam units 60 are to be employed. If the internal combustion engine 10 is a four cylinder engine, then there normally would be eight cam lobe units 60 angularly disposed along the camshaft 50, four units 60 for opening and closing the four intake valves, such as the valve 26, and the other four units for opening and closing in a timed relation the four exhaust valves. The depicted cam unit 60, has decidedly different lateral dimensions from conventional cam units, it should be stressed at this point.

Describing the cam unit 60 in detail, it will be observed that there is a relatively narrow rib constituting a base circle portion 62. The base circle portion 62 has a constant radius in the illustrated situation, subtending an arc of 180° in the pictured example. The cam unit 60 further includes a lobe portion 64, the lobe portion 64 having a working surface **64*a* of constant width that subtends an arc of 140° in the illustrated situation. There is also a first clearance ramp portion 66 and a second clearance ramp portion 68, these ramp portions 66, 68 each subtending an arc of 20°. Considering the cam unit 60 to rotate in a clockwise direction as viewed in FIG. 2, the ramp portion 66 would take up the clearance labeled 69 in FIG. 2 just prior to the lobe portion 64 beginning to open the valve 26, and the converse would occur with the other ramp portion 68 would come into play when the valve 26** has become closed.

It is important to appreciate that the widths of the base circle portion 62 and the width of the ramp portions 66, 68 are considerably narrower than the width of the lobe portion 64. The reason for the base circle portion 62 and the ramp portions 66, 68 having a reduced width with respect to that of the lobe portion 64 will soon be made manifest. Actually, the width of the lobe portion 64 is preferably more than three times the width of the base circle portion 62 and the ramp portions 66 and 68, but in any event the lobe portion 64 should be at least twice as wide as the base circle portion 62 on the ramp portions 66, 68.

Although the use of shims per se is not new for the purpose of determining, and later adjusting, the amount of lash, my invention in one embodiment employs a specially configured shim 70 comprised of a central button 72 providing a relatively small circular upper surface **72*a* that is engaged by the ramp portions 66, 68 as the camshaft 50 rotates. The button 72 has a diameter or width not greater than the width of the base circle portion 62 and the ramp portions 66, 68. In other words, the width of the button 72 is equal to or less than that of the portions 62, 66 and 68. The button 72 is formed by means of an annular groove 74. The remaining surface of the shim 70 has been denoted by the reference numeral 76 and it will be appreciated that this is a sizable follower surface that is engaged by the working surface 64*a* of the lobe portion 64. The rib 62 and the ramp portions 66, 68 can be offset with respect to the lobe portion if rotation of the valve actuator 41** is desired.

Figure 3:
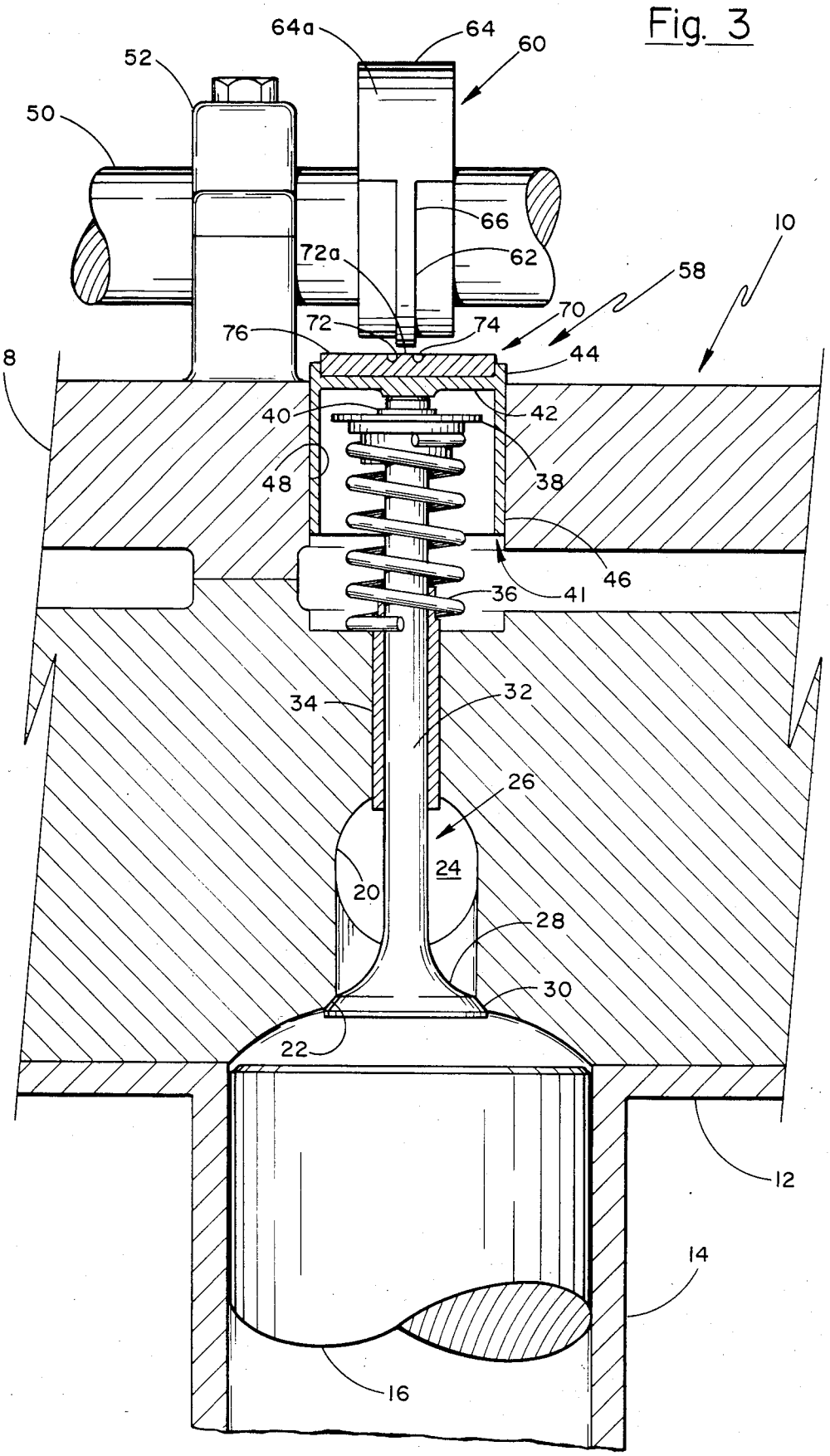
FIG. 3 is a vertical sectional view taken in the direction of line 3—3 of FIG. 1, the view showing the cam unit in elevation and a valve member in closed position.

Only a glance at, say, FIG. 3 is needed to understand the dimensional relationship that has just been mentioned. From FIG. 3, it will be perceived that the base circle portion 62 has a width corresponding to the width or diameter of the button 72, whereas the diameter of the shim 70 is sufficient so as to cause the annular working surface 76 to extend well beyond the overall width of the lobe portion 64. Perhaps this relationship can be even better appreciated by referring to FIG. 7 where the lobe portion 64 is actually engaging the shim 70 to cause the valve 26 to be forced into a fully open condition, as can be readily discerned from the spacing between the beveled edge 30 and the beveled seat 22.

Figure 2:
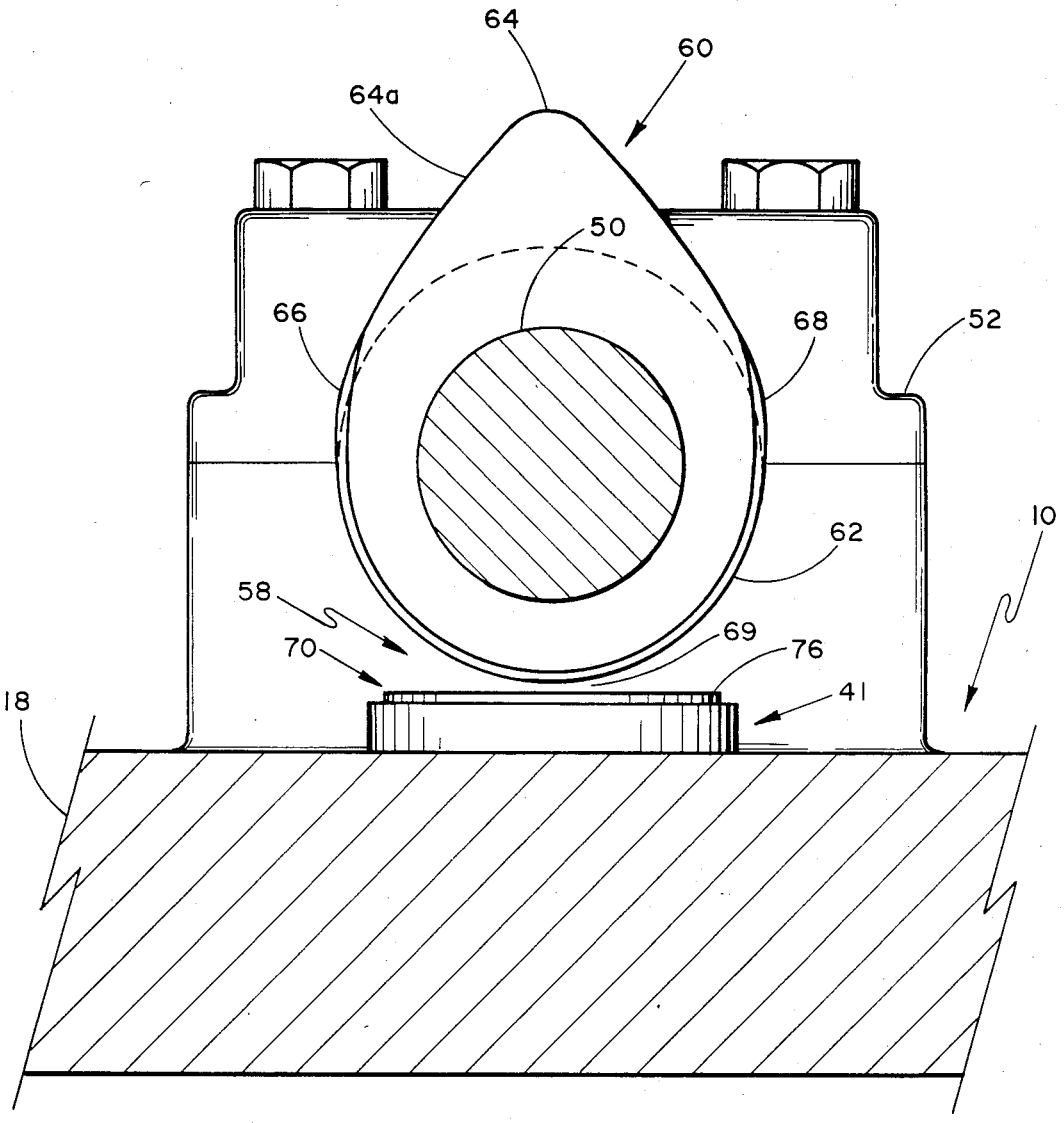
FIG. 2 is a somewhat enlarged elevational view taken in the direction of line 2—2 in FIG. 1.
Figure 4:
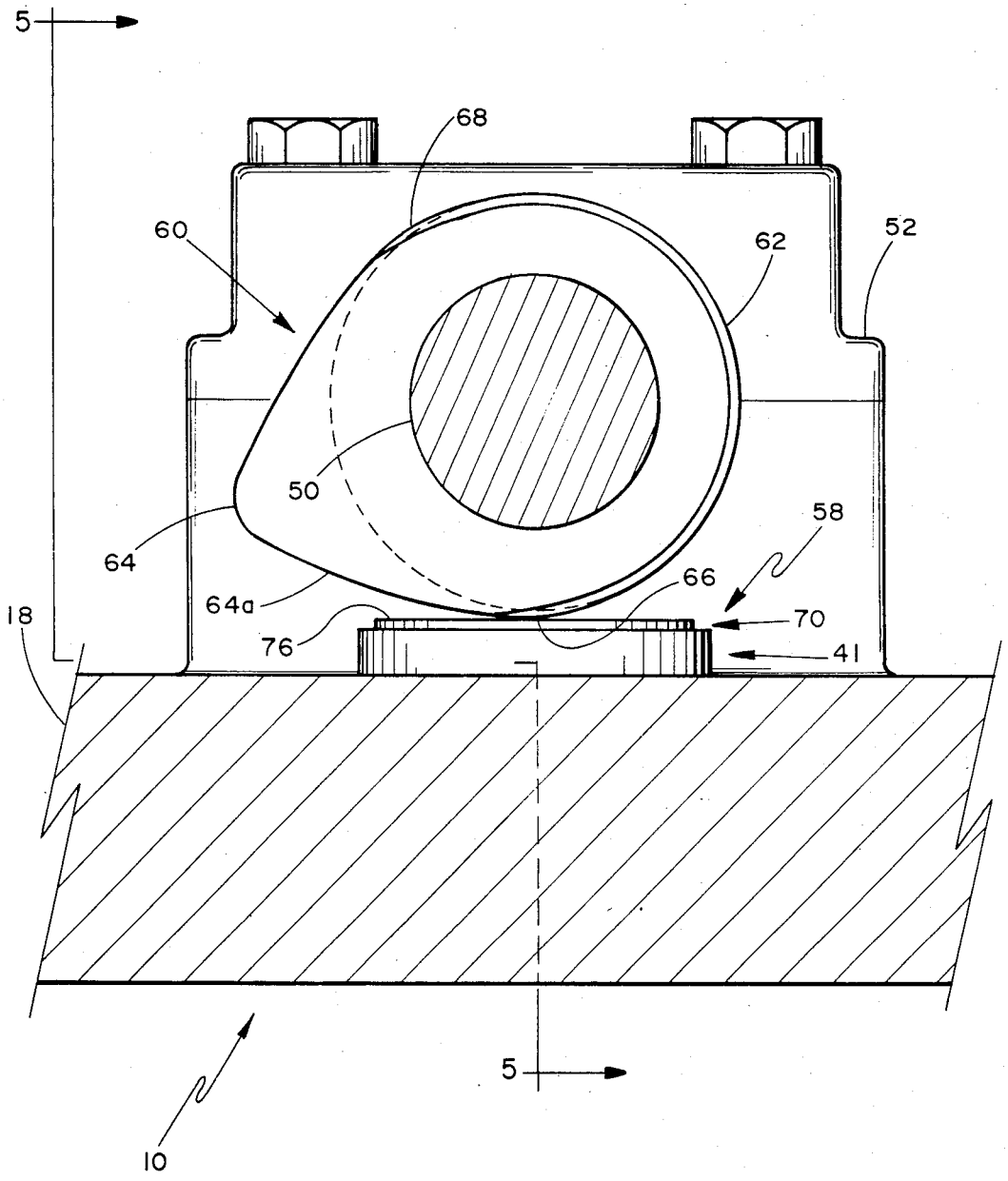
FIG. 4 is a view taken in the same direction as FIG. 2 but showing the cam unit rotated into a position in which its opening ramp is just engaging the centrally disposed button on the shim, the shim and the underlying parts appearing in section.

Assuming that the ramp portions 66, 68 have an eccentricity that increases a radial distance of 0.010 inch in the 20° span between the base circle portion 62 and the beginning of the lobe portion 64, then the thickness of the shim 70 can be such that with the greatest radius section, that is the section having the greatest eccentricity, of the ramp portion 66 just touching the button 72, as shown in FIG. 4, the lash or clearance in FIG. 2 will be 0.010 inch.

Stated somewhat differently, if an initial lash or clearance of 0.010 inch is to be obtained, and the eccentricity of the ramp portions 66 and 68 increases in radius that same amount, then the setting is automatically maintained when the appropriate thickness of the shim 70 is selected. In this way, when the cam unit 60 rotates, the ramp portion 66 takes up the lash and further rotation from the angular position of the cam unit 60 shown in FIG. 4 will cause the wider lobe portion 64 to begin opening the valve because the shim 70 acts as a cam follower for the valve actuator 41.

Figure 5:
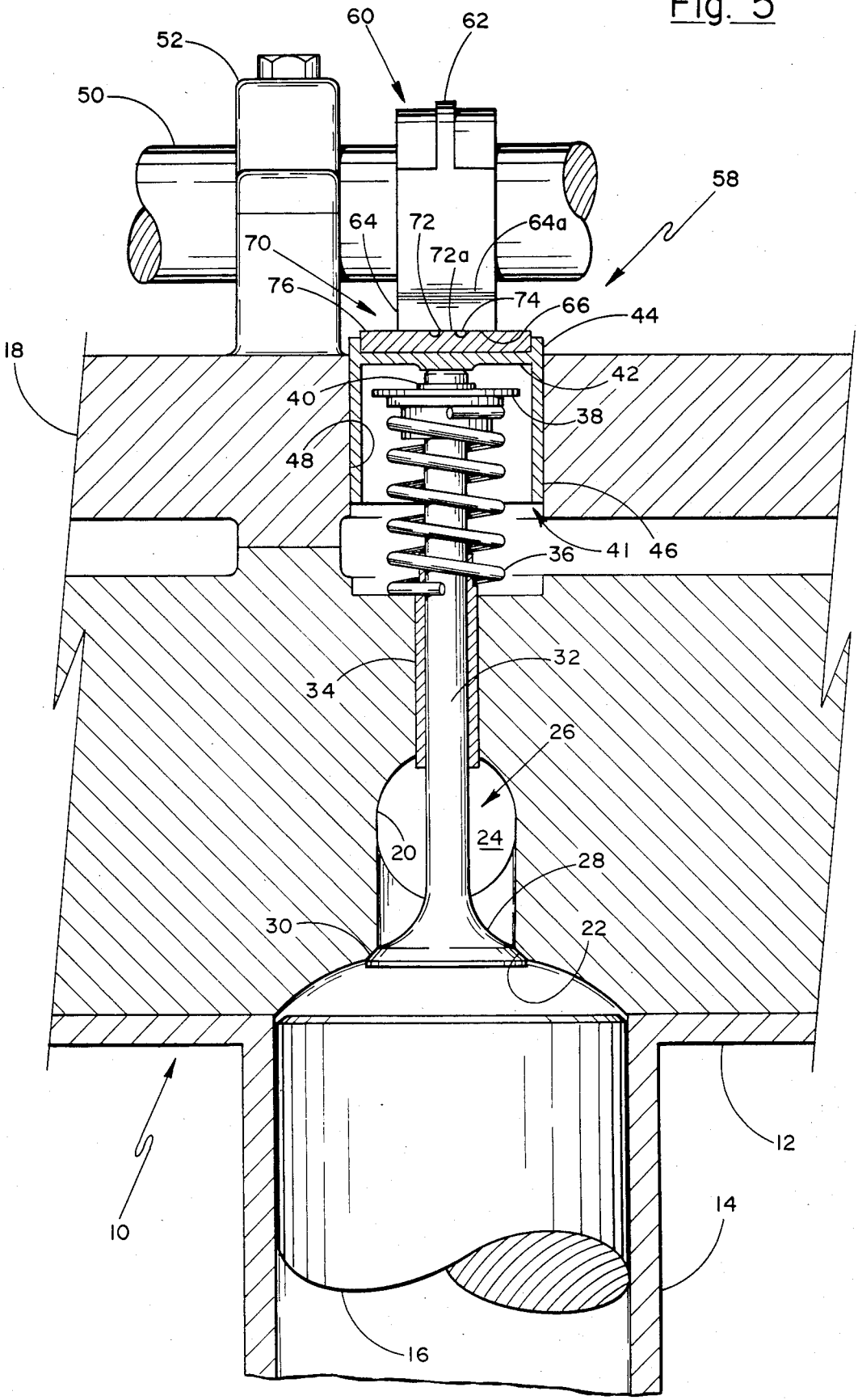
FIG. 5 is a sectional view taken in the general direction of line 5—5 of FIG. 4.
Figure 6:
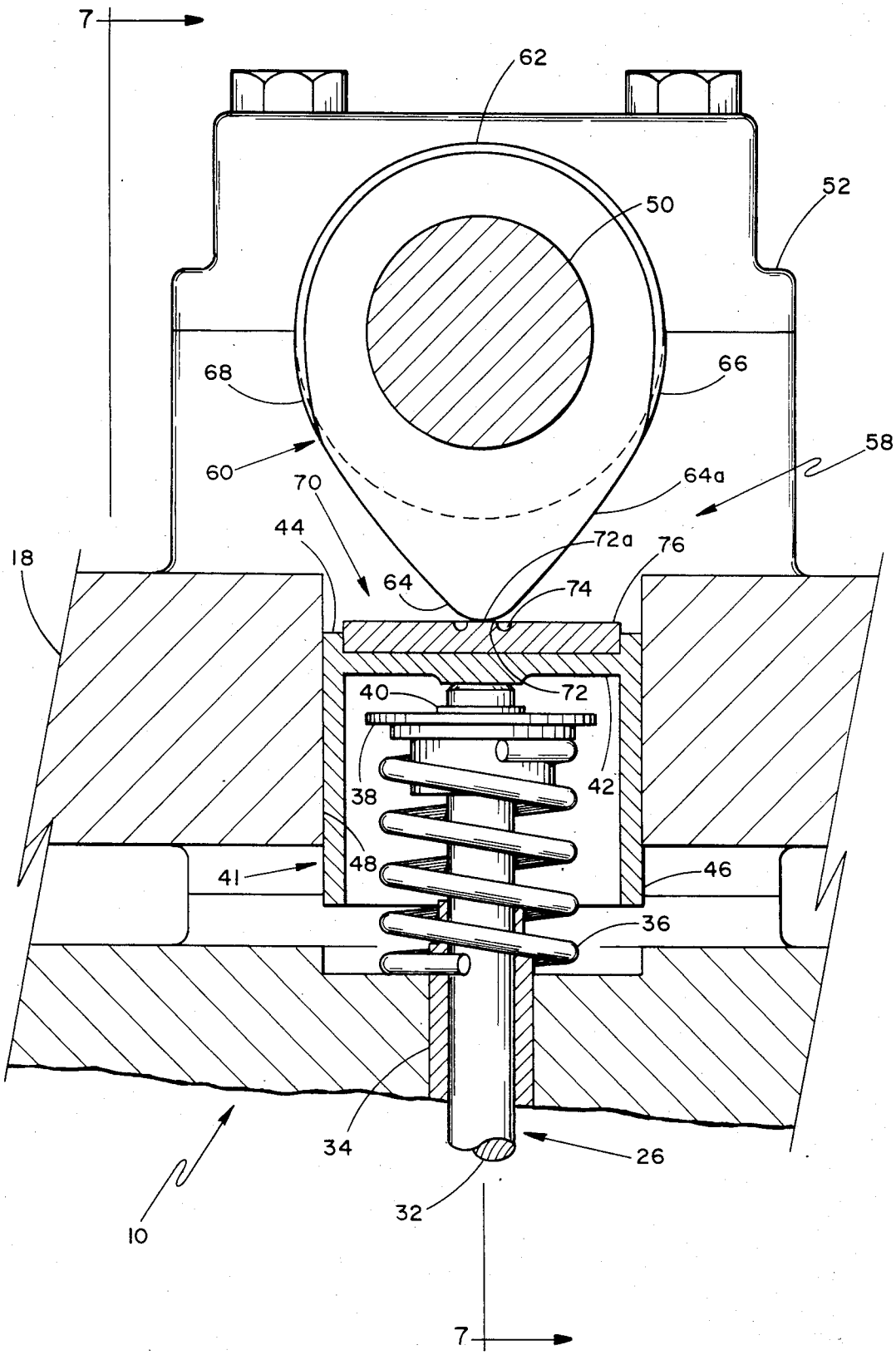
FIG. 6 is a view corresponding to FIG. 4 but with the cam unit rotated so that the lobe portion thereof is forcing the valve to a wide-open position and the piston having moved downwardly from its upper position of FIG. 4.

Consequently, the valve 26 is progressively opened during the time that the cam unit 60 rotates from the position in which it appears in FIG. 4 to that in which it appears in FIG. 6. It should be noted, though, that when the cam unit 60 is in the position shown in FIG. 4, and also as shown in FIG. 5, then the relatively narrow ramp portion 66 is overlying the button 72. Hence, any decrease in the originally obtained lash of 0.010 inch will cause the ramp portion 66 to progressively bear harder against the upper surface 72*a* of the button 72 with the consequence that the button 72 will be eroded, that is, will wear down to the extent that the selected 0.010 inch lash clearance will be maintained; the valve 26, in this way, will be permitted to completely close.

In other words, the original lash is maintained because what would otherwise be a decrease in lash is compensated for by the wearing away of some of the metal constituting the button 72. It must be kept in mind that the lash is initially determined by virtue of the relationship of the ramp portion 66 relative to the button 72. Since the ramp portion 66 subtends an arc in the illustrative situation of 20°, it should be readily apparent that even where the cam unit 60 and the shim 70 are of the same metal, the greater length of the working surface provided by the ramp portion 66 will bear progressively harder against the relatively restricted working surface belonging to the button 72. Should the lash tend to become less than the selected 0.010 inch, the clearance ramp portions 66, 68 would then attempt to function as opening and closing ramps, respectively; however, the greatly increased pressure between the ramp portions 66, 68 and the button 72 would begin to wear away the button 72 in that its surface area 72*a* is much less than that of either ramp portion 66 or 68.

However, in general, the wearing away of the button 72 does not interfere with the working engagement between the lobe portion 64, more specifically its working surface 64*a*, and the annular working surface 76 belonging to the shim 70. Inasmuch as the cam lobe 64 acts over a considerably wider surface, it is very unlikely any groove would be worn in the annular working surface 76. If the relatively narrow portions 62, 66 and 68 were not employed, and instead constituted the same width as the lobe 64, then to compensate for any decrease in lash, the lobe portion 64 would have to wear a relatively wide groove to compensate for the change in lash. Since this is not likely to occur, as indicated just above, the valve head 28, more specifically its beveled edge 30, would not seat against the beveled seat 22 and the valve head 28 would remain open even when the valve 26 should be completely closed. This, quite obviously, would adversely affect the efficiency and longevity of the engine 10.

Figure 7:
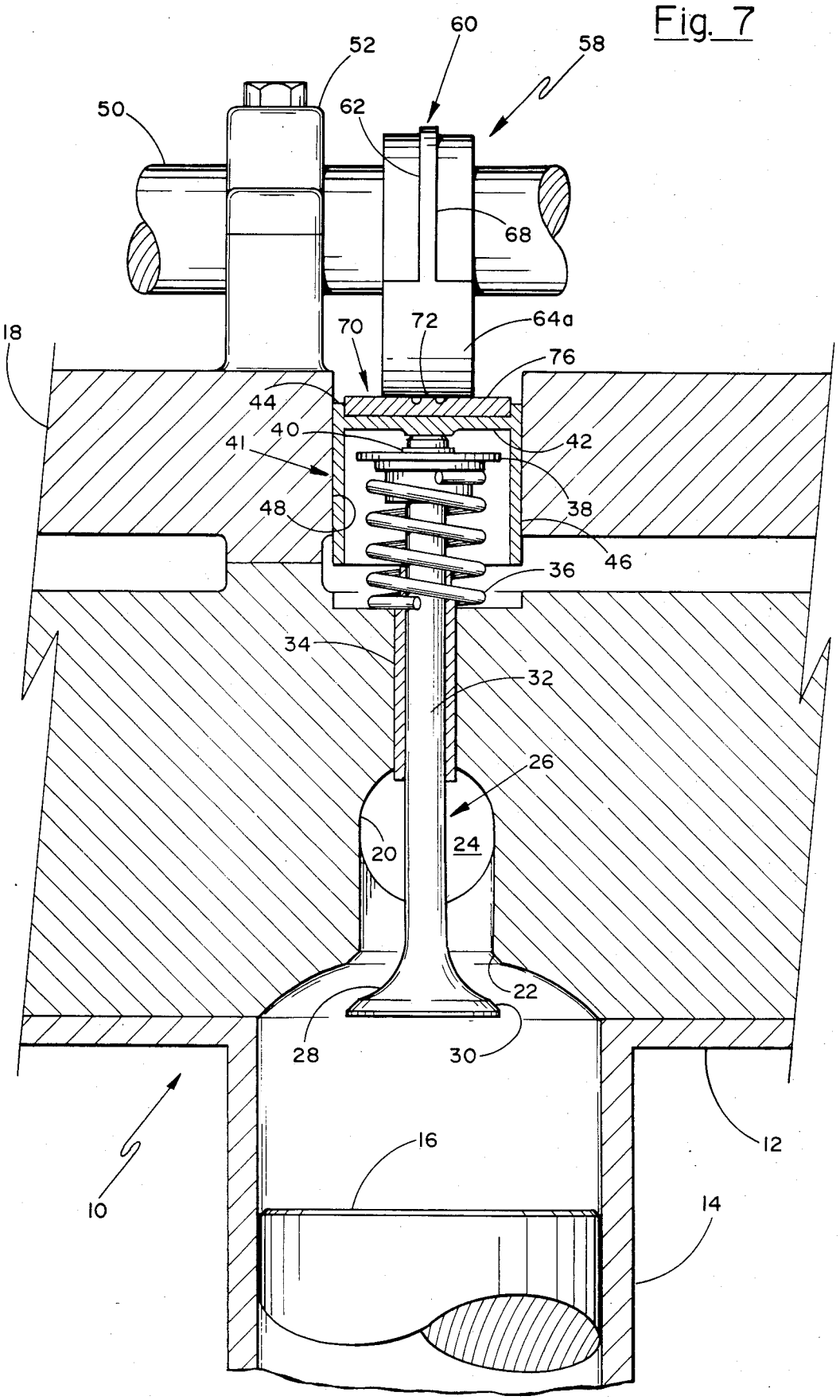
FIG. 7 is a sectional view taken in the general direction of line 7—7 of FIG. 6.
Figure 8:
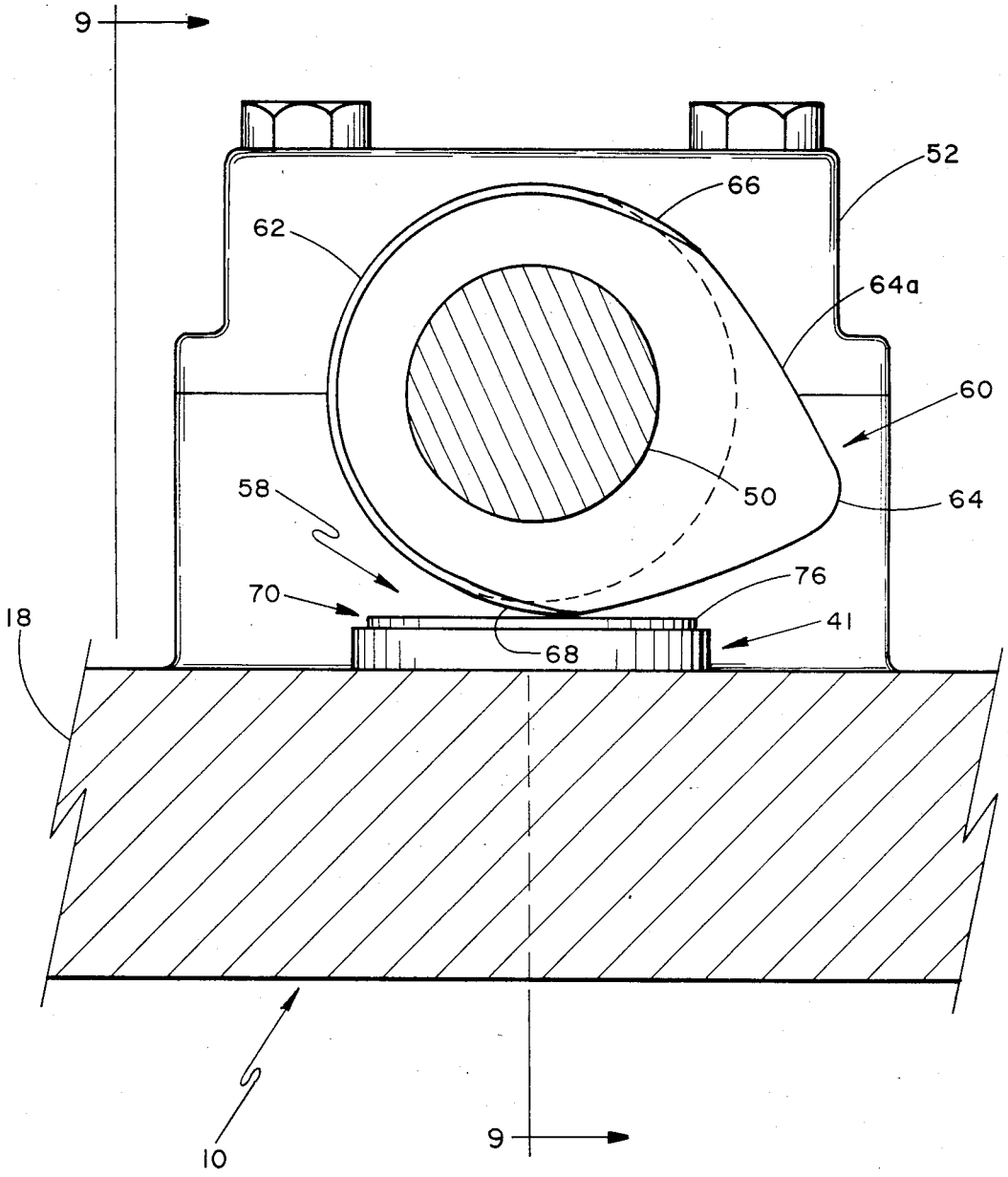
FIG. 8 is a sectional view resembling FIG. 4 but with the closing ram just touching the centrally disposed button.
Figure 9:
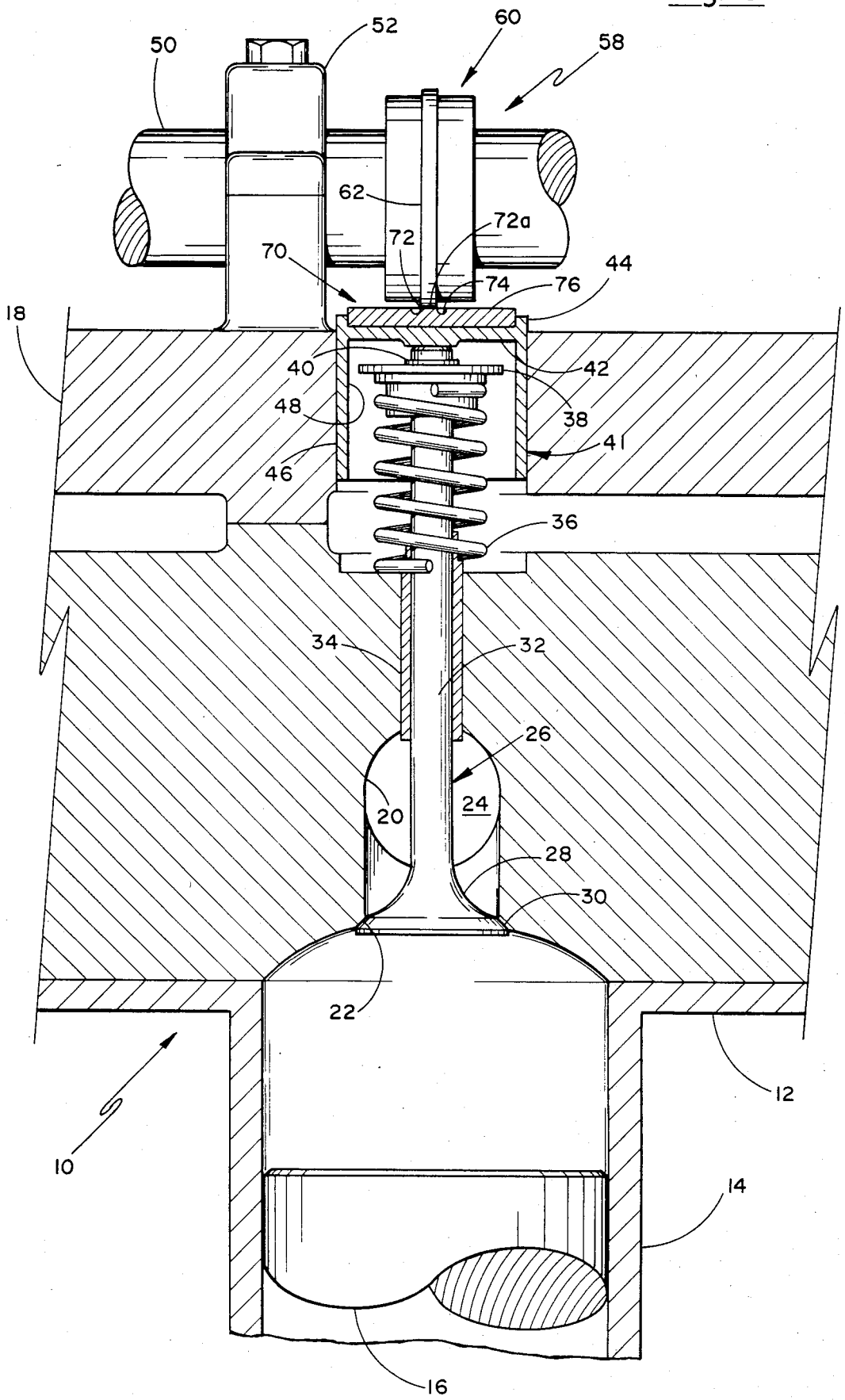
FIG. 9 is a sectional view taken in the direction of line 9—9 of FIG. 8.

As the valve 26 starts to close, as can be appreciated from FIGS. 7 and 8, then the closing ramp portion 68 overlies the button 72. This overlying relationship, as the lash decreases, causes the closing ramp portion 68 to rub and wear against the upper surface of the button 72

However, the usual wearing is between the ramp portions 66, 68 and the button 72, thereby preserving the initial amount of lash or clearance. If there should be an abnormally severe decrease in lash in which the button 72 wears down to the extent that the ramp portions 66 and 68 start to engage the edges of the working surface 76 bordering the annular groove 74, then the working surface 76 would start to wear. However, any such erosion of the surface 76, should it occur, is indeed negligible, being only a minute percentage, at the most, of the total area engaged by the lobe portion 64.

Irrespective of how the lubrication is achieved, it will be understood that with the initial amount of lash preserved, there is sufficient clearance for oil to accumulate each revolution of the camshaft 50. In other words, the clearance appearing in FIG. 2 enables a sizable amount of oil to enter between the base circle portion 62 and the upper surface of the shim 70. While the lobe portion 64, once each revolution of the camshaft 50, literally squeezes out the oil, as should be evident from FIGS. 6 and 7, the supply of oil, even though a limited amount, is replenished when the clearance or lash reoccurs which is during the time that the base circle portion 62 is over the shim 70.

There are various reasons for the lash tending to decrease. As can be appreciated from a number of the views, should the valve stem 32 increase in length, either from heating or metal fatigue, there would be a decrease in the amount of lash from what has initially been set. Also, the constant pounding of the valve head 28 on the valve seat 22 will erode either or both the beveled edge 30 and the beveled seat 22. Although not appearing in any of the drawings, steel inserts are frequently employed in conjunction with a head 28 of aluminum. Such steel inserts tend to retract or move upwardly into the aluminum head, literally being hammered upwardly by the valve head 28 as it repeatedly is closed.

Even should there be an increase in the valve lash, it will be recognized that any increase is with respect to a minimum amount of initial lash. In the illustrative situation, the initial lash has been selected, although somewhat arbitrarily, to be 0.010 inch. However, the ramp portions have an eccentricity of 0.010 inch so when the initial adjustment, by selecting the proper thickness for the shim 70, is determined so that there is no clearance when the ramp portions 66, 68 are just engaging the button 72. In this way, any increase thereafter in lash will be with respect to the ramp portions 66 and 68. In other words, with zero clearance initially between the ramp portions 66, 68 and the button 72, whatever increase in lash later occurs will be from this zero or contact relation. Stated somewhat differently, it is possible that in some applications of my invention lash clearances as small as zero might be utilized. This is permissible because advance allowance or compensation for wear-induced valve lash need not be taken into account in the initial lash setting. Thus, my invention enables a very small amount of lash, even down to zero, to be initially selected and any variation will be relative to the very small amount of lash that is initially selected.

Having described the actuating apparatus 58 constituting one embodiment of my invention, a modification thereof will now be referred to. Therefore, attention is directed at this time to FIG. 10 in which the modified valve actuating apparatus has been indicated generally by the reference numeral 158. Inasmuch as most of the parts are the same as in the apparatus 58, identical reference numerals will be indicated to denote the same parts. However, the shim has been appreciably altered, being of a composite construction, has been assigned the reference numeral 170. The shim 170 includes a case-hardened, high carbon steel disk 174 and an insert 176 of relatively soft mild steel (or a soft metal alloy). The disk 174 is formed with a bore or hole 178 and a counterbore 180. The insert 176 includes a circular flange 182 and a centrally disposed button 184. The diameter of the bore 178 is snugly related to the diameter of the button 184 and the diameter of the counterbore 180 is closely related to that of the flange 182.

Figure 10:
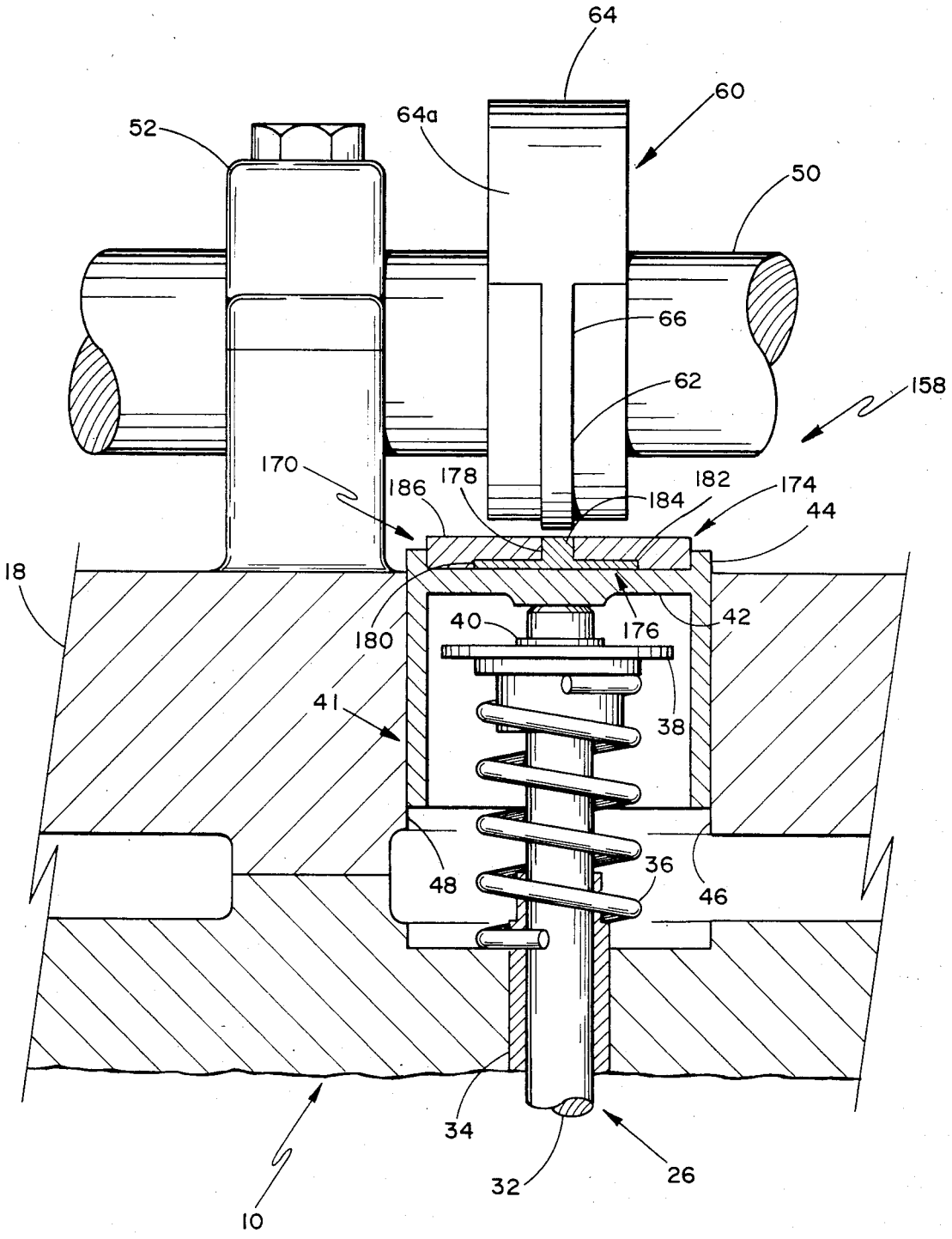
FIG. 10 is a sectional view similar to FIG. 3 but depicting a composite shim construction.

From FIG. 10 it will be perceived that the button 184 is equal in diameter to the width of the base circle portion 62 of the cam unit 70. The annular surface denoted by the reference numeral 186 corresponds to the annular surface 76 of the apparatus 58, constituting the working surface against which the major segment of the lobe portion engages. Thus, the shim 170, is of a composite construction as far as the apparatus 158 is concerned, being composed of the relatively hard disk 174 and the relatively soft insert 176. Actually, it is the relative softness of the button 184 with respect to the softness of the cam unit 60 that is essential. What is desired is that any wear that occurs, such as when there is a decrease in lash, transpires by reason of the button 184 being relatively soft. In this way, the button 184, even though its limited area **184*a* is flush with the upper surface of the shim 170, wears readily in order to maintain the original amount of lash. As previously mentioned, the amount of original lash has been selected to be 0.010 inch for illustrative purposes. Whatever lash is selected, though, can be preserved. Even if segments of the surface 186 should wear, which would occur only adjacent the opposite edges of the button 184, such erosion would for all intents and purposes be negligible when measured in relation to the overall area of the annular surface 186**.

Figure 11:
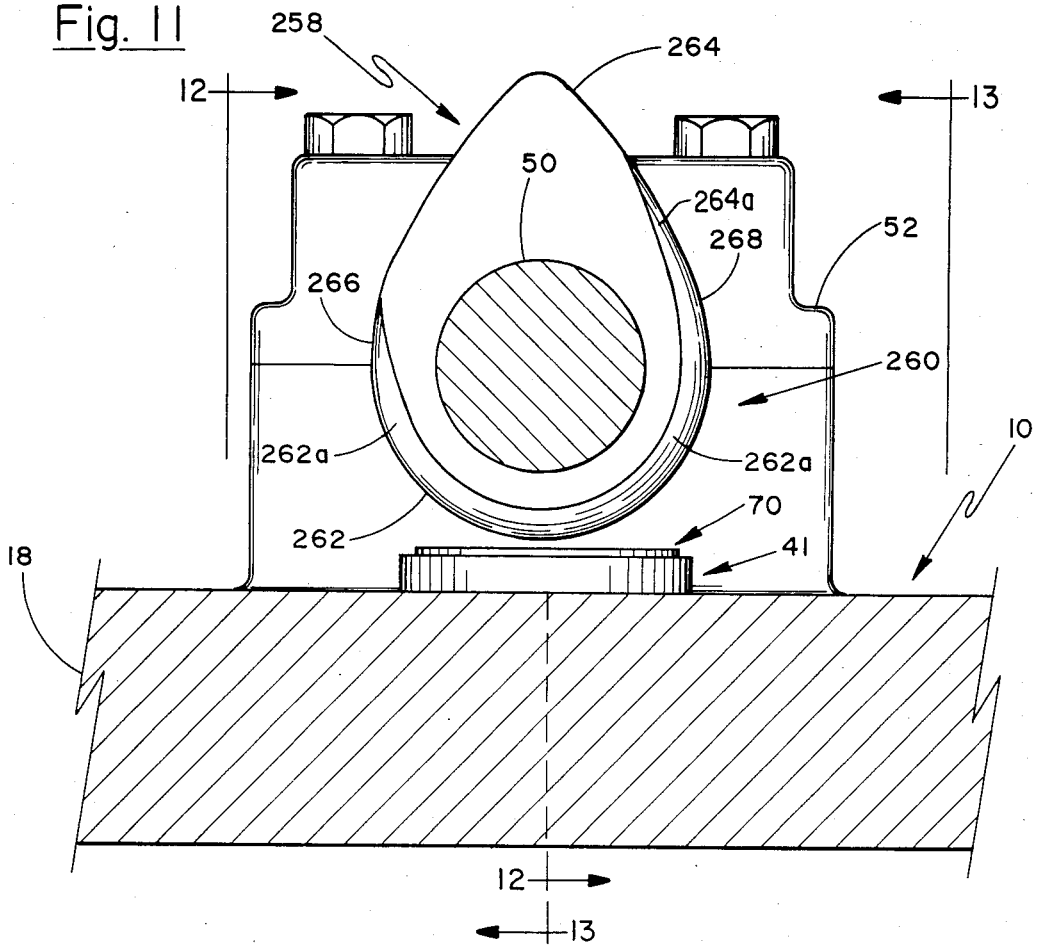
FIG. 11 is a view corresponding to FIG. 2 but illustrating a tapered cam unit providing a diverging working surface on one side of the lobe portion.
Figure 12:
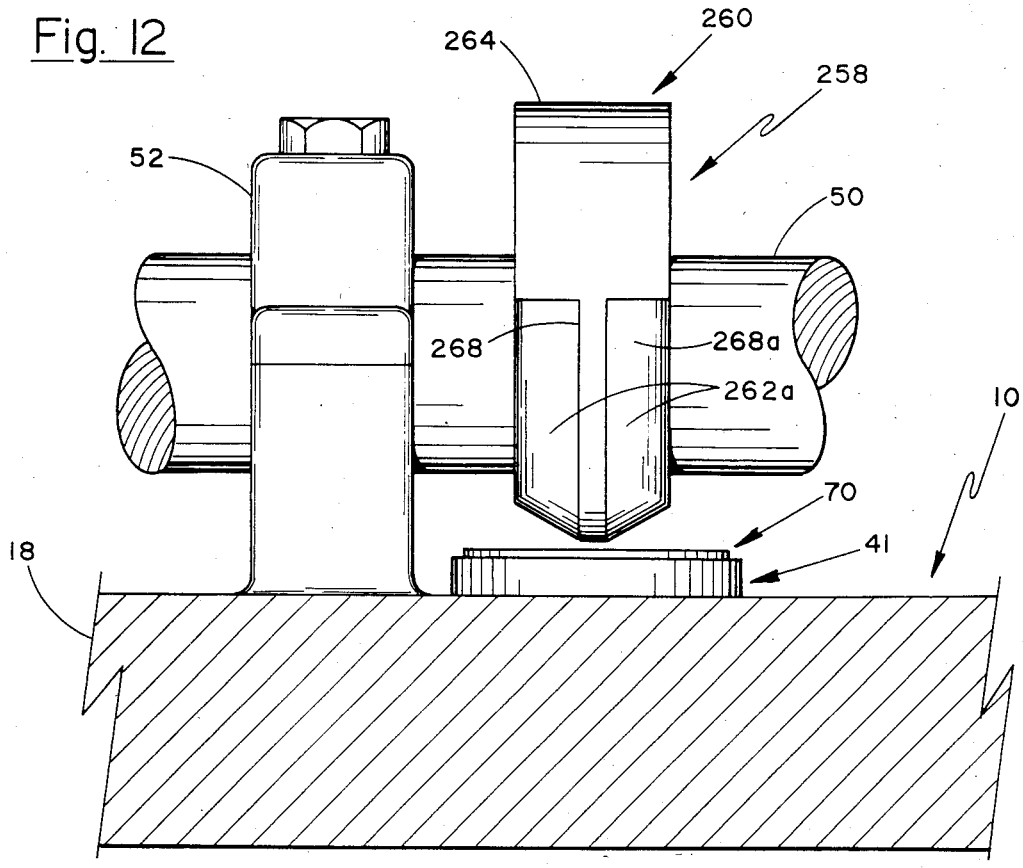
FIG. 12 is a front elevational view taken in the direction of line 12—12 of FIG. 11.
Figure 13:
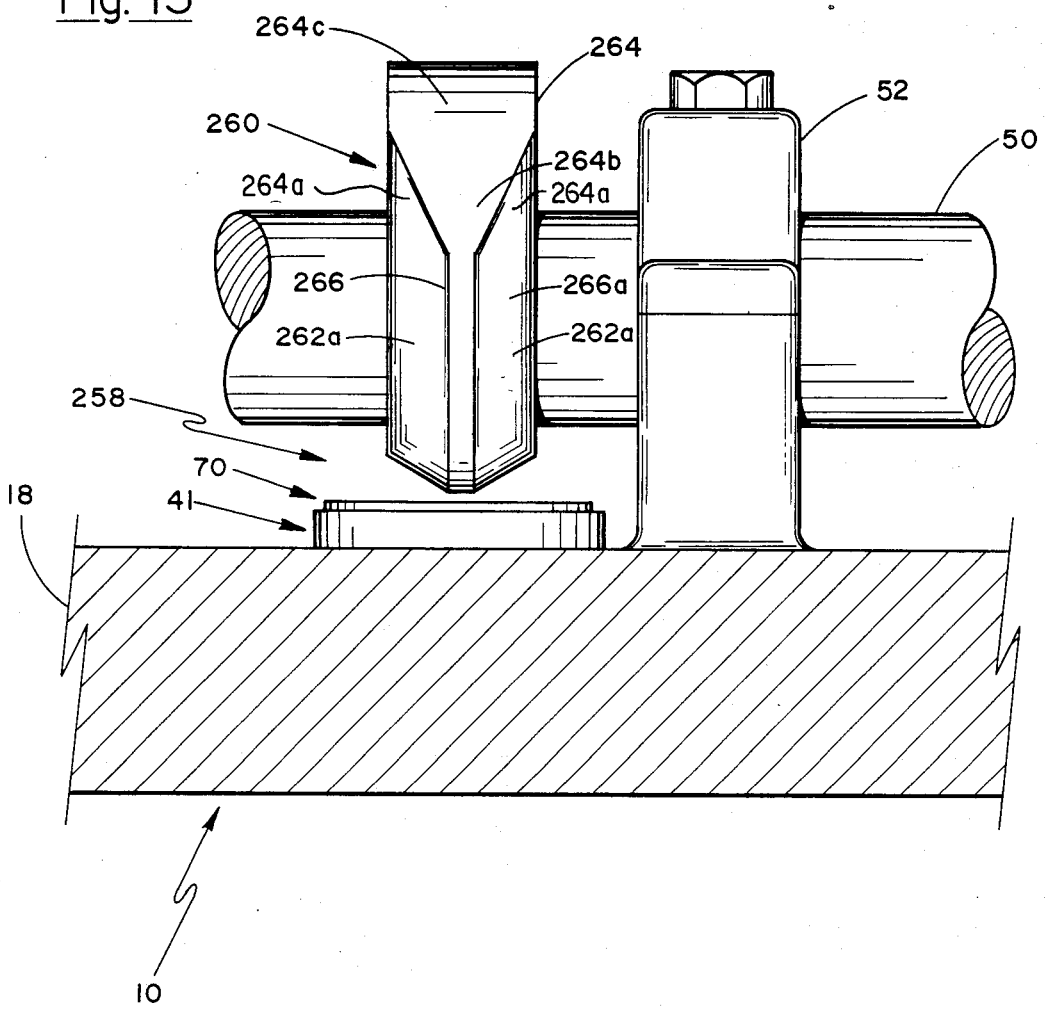
FIG. 13 is a rear elevational view taken in the direction of line 13—13 of FIG. 11.

What will be referred to as still another modification of the invention appears in FIGS. 11, 12 and 13. In this instance, the modified apparatus has been given the reference numeral 258. In this embodiment, it is the cam unit 60 that has been modified, so the altered cam unit has been assigned the reference numeral 260. The cam unit 260 includes a base circle portion 262, a lobe portion 264 and ramp portions 266, 268. Hence, the function of the portions 262–268 corresponds to the function of the portions 62–68.

However, in the apparatus 258, a considerable amount of the cam unit 260 adjacent each side of the base circle portion 262 has been tapered, as believed clearly evident from the right side of FIG. 11, from FIG. 13, and to some degree from FIG. 12. The taper has been denoted by the reference numeral **262*a*, and although the reason therefor will presently be explained it should be noted at this time that the taper 262*a* is more pronounced on the right as viewed in FIG. 11 (and also FIG. 13), decreasing to a lesser amount at the left in FIG. 11 (and also FIG. 12). This makes the camshaft 250 lighter than the camshaft 50. Nonetheless, the base circle portion 262 exists between the tapered sides 262*a*. In addition to the tapered or inclined surfaces 262*a*, the ramp portions 266 and 268 have tapered or inclined surfaces labeled 266*a* and 268*a***, respectively.

More importantly perhaps is the taper or divergence imparted to the working surface of the lobe portion 264. There are sloping or tapered surfaces **264*a* but they terminate in a spaced relation with the tip of the lobe portion 264. As can best be understood from FIG. 13, the working surface of the lobe portion 264 has a divergent or progressively widening surface indicated by the reference numeral 264*b*. The diverging or enlarging surface 264*b* merges into a full width working surface indicated by the reference numeral 264*c***.

The advantage of the modified cam unit 260 resides in the fact that a relatively great surface area exists when the valve 26 is actuated into a fully open position. It perhaps will be well to refer back to FIGS. 6 and 7, particularly FIG. 7, where the full width of the lobe portion 64 is effective when the valve 26 is actuated into its wide open position. This is where the greatest amount of force is needed and also where the greatest amount of surface contact is employed. Consequently, the left side of the lobe portion 264 has the same full width throughout the side thereof that faces the viewer in FIG. 12, which of course is the left side of the lobe 264 as far as FIG. 11 is concerned.

However, when the valve 26 is closing under the influence of the spring 36 not as much force is being exerted against the lobe 264. Consequently, there is an advantage in not having as much surface contact between the cam unit 260 during the closing of the valve 26 as when the valve 26 is being opened. In this embodiment of my invention, the amount of lobe surface is made proportional to the stress to which it is subjected when both opening and closing the valve 26.

In other words, the rubbing action across the shim 70 is decreased when utilizing the construction shown in FIGS. 11, 12 and 13, for during either the closing of the valve when less force is being used in contradistinction to a greater amount of force when the valve is being opened the divergent surface **264*b* is made use of. Once again, from FIG. 13, it will be seen that the width decreases, actually decreasing from the full width of the working surface 264*c* to the width of the ramp portions 268. Once again it is important to understand that the lobe portion 264 is configured so as to increase the lobe contact area with respect to the shim 70 in proportion to the loading imposed on the lobe portion 264**.

I claim:

1. Apparatus for actuating a valve member relative to a valve seat associated with a combustion chamber of an internal combustion engine comprising a cam unit rotatable about an axis spaced from said valve seat, said cam unit including a lobe portion and ramp portions having a reduced width in relation to the width of said lobe portion, said ramp portions extending in opposite angular directions from said lobe portion, and cam follower means associated with said valve member having a generally flat working surface engageable by said reduced width ramp portions and said lobe portion, said cam follower means including a follower portion no wider than said reduced width ramp portions, said lobe portion spanning said follower portion and spanning a portion of said working surface to one side of said follower portion.

2. Valve actuating apparatus in accordance with claim 1 in which said lobe portion also spans a portion of said working surface to the other side of said follower portion.

3. Valve actuating apparatus in accordance with claim 1 in which said cam follower means includes a shim, said shim providing said working surface and having a button providing said follower portion.

4. Valve actuating apparatus in accordance with claim 3 in which said button is integral with said shim and said shim is formed with a groove encircling said button.

5. Valve actuating apparatus in accordance with claim 3 in which said shim includes an insert fixedly mounted therein, said insert providing said button.

6. Valve actuating apparatus in accordance with claim 5 in which said shim includes a disk of relatively hard metal and said insert, including said button, is of relatively soft metal.

7. Valve actuating apparatus in accordance with claim 6 in which said cam unit is of relatively hard metal.

8. Valve actuating apparatus in accordance with claim 1 in which said cam unit includes a base circle portion, said ramp portions increasing in radius from said base circle portion to said lobe portion so that said ramp portions wear against said follower portion upon a sufficient decrease in the spacing between the axis about which said cam unit rotates and said valve seat.

9. An actuator for use with the valve of an internal combustion engine comprising a shim having a centrally disposed button providing a restricted working surface and having an annular portion providing a larger working surface, said working surfaces residing in the same plane.

10. A valve actuator in accordance with claim 9 in which said button is an integral portion of said shim.

11. A valve actuator in accordance with claim 10 in which said button is formed by an annular groove between said button and said larger working surface.

12. A valve actuator in accordance with claim 9 in which said button is of a softer material than said larger working surface.

13. A valve actuator in accordance with claim 12 including a disk and a removable insert, said button being integral with said removable insert.

14. A valve actuator in accordance with claim 13 in which said disk has a bore and counterbore formed therein, said button being of a size to fit in said bore and said insert having a flange of a size to fit in said counterbore.

* * * * *